US006007007A

United States Patent [19]

Haack et al.

[11] Patent Number: 6,007,007

[45] Date of Patent: Dec. 28, 1999

[54] CUTTER ASSEMBLY FOR MEAT GRINDER

[75] Inventors: Eberhard Haack, Halle; Richard Meyenschein, Schriesheim, both of Germany

[73] Assignee: Ing Eberhard Haack, Halle, Germany

[21] Appl. No.: 09/237,997

[22] Filed: Jan. 26, 1999

[30] Foreign Application Priority Data

Jan. 26, 1998 [DE] Germany ..... 198 02 782

[51] Int. Cl.[6] ..... B02C 18/36

[52] U.S. Cl. ..... 241/82.1; 241/82.2; 241/82.3

[58] Field of Search ..... 241/82.1, 82.2, 241/82.3, 82.4, 82.5, 82.7, 69

[56] References Cited

U.S. PATENT DOCUMENTS

| | | | |
|---|---|---|---|
| 517,148 | 3/1894 | Scheffel | 241/82.2 |
| 1,007,016 | 10/1911 | Weir | 241/82.3 |
| 1,910,261 | 5/1933 | Royle | 241/82.3 X |
| 4,003,521 | 1/1977 | Hess | 241/82.4 |
| 4,844,372 | 7/1989 | Weiler et al. | 241/82.4 |

*Primary Examiner*—John M. Husar
*Attorney, Agent, or Firm*—Karl Hormann

[57] ABSTRACT

The invention relates to a cutter assembly for use in a meat grinder which consists of a disc perforated by bores of diameters which vary over the length of the bores thereby to provide dwell and massage zones and a rotatable knife in sliding engagement with one of the surfaces of the disc, the knife consisting of a peripheral ring and a hub with a plurality of evenly spaced first knife blades extending from the ring toward the hub, a plurality of evenly spaced second knife blades extending from the hub toward the ring, and a plurality of evenly spaced third knife blades extending from the hub to the ring, the knife blades forming between them cutting zones. The configuration of the perforations and the knife blades ensures cutting raw materials into particles of uniform size.

18 Claims, 4 Drawing Sheets

CUTTER ASSEMBLY FOR MEAT GRINDER

BACKGROUND OF THE INVENTION

1. Field of the Invention

The invention, in general, relates to a cutter assembly and, more particularly, to a combination of a perforated disc and a knife for use in meat grinders or similar diminution machinery provided with feed screws or augers rotatably mounted in a pressure housing and with single or multiple-component cutter sets.

2. The Prior Art

In its simplest form, a cutter set for meat grinders is made up of a perforated disc rigidly mounted in the cutter housing of the meat grinder and of a knife associated with the perforated disc and rotatably driven by the feed auger provided with an axial stub for receiving the knife. An arrangement of a plurality of knives and perforated discs constitutes a multiple-component cutter assembly.

During rotation of the knives, their cutting edges move over the surfaces of the perforated discs to chop the material advanced against the surfaces of the perforated disc facing the interior of the housing or, in the event, the flow of the material. The perforations in the discs are fabricated in various ways and, depending upon their disposition in the surface of the disc, they participate in the acceptance and movement of the material. The reason for this is that the perforations or bores are distributed over the entire surface of a disc, arranged in different coordinates and disposed in different ways relative to the arms of the knives. The different dispositions and different pressure build-up in the raw material lead to different feed processes in individual perforations or segments of a perforated disc.

The state of the art is replete with perforated discs and rotary knives used in such cutter assemblies. The perforated discs serve not only to receive within their perforations the material being processed, but also to compact and support the material, their edges functioning as counter blades for the rotating knife to accomplish the cutting or chopping action.

To function as counter blades the perforated discs are made from tool and other high-quality steels of a Rockwell C hardness of between about 50 and about 62. Moreover, the selected material, the perforation density and the number of perforations in a given disc are of the utmost importance as regards the rate of feed of material through the disc, and they bear upon the quality of the entire cutting assembly.

Hitherto, perforated discs have been made to provide a plurality of perforations constituting bores with little resistance to material feeding, care being always taken to ensure disposition of these perforations such that they provide sharp edges relative to the surface of the disc and to provide a high-grade surface smoothness to interfere as little as possible with the feeding of the material through the perforations.

Thus, German Patent DD 277,399 relates to the problem of an optimum perforation density in a disc. As disclosed, the surface ratio between perforated and non-perforated areas is between 0.2 and 0.3, the density is between <60 and 80%. The connected surface portions are said to constitute a system of secondary cutting edges, and the width of a perforated disc structured in this manner is to be in certain proportion to the diameters of the perforations. The width of perforated discs structured in this manner is to between about 0.125 to about 0.25 times the diameter of the bores.

German Patents 3,821,930 and 4,338,347 relate to the material of perforated discs relative to mechanical processing and to its matching with a given knife. In particular, German Patent 3,821,930 describes a meat grinder the perforated disc and knives of which are covered by a ceramic coating. Suitable ceramic materials are aluminum oxide ($Al_2O_3$), zirconium oxide ($ZO_2$), silicon carbide (SiC) or mixtures of such materials.

With a view to reducing the technical complexity of the manufacture and its costs, German patent 4,338,347 discloses a perforated disc for meat grinder cutter sets made of grey cast iron, preferably spheroidal graphite cast iron or laminar cast iron with a Rockwell C hardness between about 25 and 28.

All perforated discs hitherto known have been structured in the mentioned manner, care having always been taken to ensure the perforations are as sharpedged as possible and that the wall surfaces of the perforations were as smooth as possible for feeding the material through the disc perforations substantially without interference. This has been found to be disadvantageous, however, because the material could only be fed through the perforations, always in as straight a feed direction through the perforated disc and cutter set as possible. This does not, however, positively affect the cohesion of the material being chopped.

A further disadvantage of known knives and perforated discs is the different cutting sequences which leads to particles or grains of different sizes within the perforations of the disc and, hence, to different levels of pressures pressure in given areas of the perforated disc.

OBJECTS OF THE INVENTION

It is an object of the invention to provide perforated discs and knives for cutter sets of meat grinders of reduced cost and complexity as regards the manufacture of the perforated discs.

Another object of the invention is to provide a perforated disc providing increased dwell time of the material within the perforations.

It is also an object of the invention to provide a perforated disc of the kind referred to which provides for improved cohesion of the material by deflection of its cross section.

Yet another object of the invention is to provide a perforated disc of the kind referred to which provides for improved cohesion of the material by changing its cross section.

Still another object of the invention is to provide a perforated disc and knife assembly for meat grinders ensuring uniform size of the chopped pieces of material.

Other objects will in part be obvious and will in part appear hereinafter.

BRIEF SUMMARY OF THE INVENTION

In accordance with a currently preferred embodiment of the invention there is provided an assembly consisting of a rotatably driveable knife provided with hanging, standing or uninterrupted blades and of a perforated disc provided with stepped perforations of different diameters and divided into a dwell zone and a massage zone, the perforations being disposed in parallel relationship to the axis of the perforated disc.

In contrast to hitherto known perforated discs, the perforations of the disc in one embodiment of the invention are of stepped configuration. In another embodiment the perforations are provided with a shoulder or neck. The material to be fed through the perforated disc is retained at these steps or shoulders and is rolled, kneaded or rotated before it is ejected from the perforation. As a result of this action, the material assumes a state of enhanced cohesion and improved water absorbency In accordance with another preferred embodiment of the invention, the blades or arms of the knives are of different configurations. They may be uninterrupted knife arms extending from a peripheral ring to the hub of the knife, or they may be hanging or standing blades extending from a peripheral ring in the direction of the hub or extending radially from the hub to the peripheral ring. Combinations of hanging and standing blades are also possible. A knife may consist of three or four evenly spaced blades or arms providing between them equally sized cutting zones.

The particle size of the chopped material is determined by the shape of the knife blades and by the length of time the material penetrated into a given perforation is exposed to the blade.

Structure and disposition of the perforations in the disc, the configuration of the knives as well as the matching between knives and disc result in a certain cooperative relationship and provide for effective spacings of the knife blades relative to a given number of perforations of the disc within the effective range of the knife blades.

Hence, there are equal spacings between individual knife blades and perforations as well as an equal number of perforations in individual cutting zones. This ensures equally sized chopped material particles and homogenous processing conditions as a result of the effect the internal configuration has upon the material.

In accordance with a further advantageous embodiment of the invention, the perforations in a disc may be of different cross-sectional configurations. The perforations are arranged within the surface of a disc such that their number and spacing are identical in each cutting zone. The perforations may be of circular or other cross-sectional configuration such as, for instance, square or polygonal.

Preferably, the perforations are not smooth and uninterrupted but stepped to provide different cross-sections disposed such that there is an equal number of such perforations at a defined spacing from the knife blades. The perforations may be configured to have one or more shoulders or strictures intermittently reducing the diameter of a perforation in the direction of its output end. In another configuration, the perforations may have relatively wide openings at both ends with an intermediate stricture.

In a further advantageous embodiment of the invention, the perforations may be formed by two radially offset sections.

Proper selection of the diameter of the perforations causes the surfaces of a chopped particles to be roughened, massaged and rubbed upon entering the perforation, whereas the zonal arrangement of knife blades results in a uniform particle size thus increasing the cohesion and absorbency of the chopped material. Other advantages derived from the invention are improved quality of the final product and reduced processing time.

BRIEF DESCRIPTION OF THE SEVERAL DRAWINGS

The novel features which are considered to be characteristic of the invention are set forth with particularity in the appended claims. The invention itself, however, in respect of its structure, construction and lay-out, as well as manufacturing techniques, together with other objects and advantages thereof, will best be understood from the following description of preferred embodiment when read with reference to the appended drawings, in which:

DETAILED DESCRIPTION OF PREFERRED EMBODIMENT

Perforated discs 1 of the kind useful in the context of the present invention are of a basic structure similar to well-known discs of this kind and consist of a body member 2 provided with a center bore 3 for rotatably receiving an axial stud of a feed auger (not shown). As will be described hereinafter, knives in accordance with the invention may be provided with a plurality of blades disposed at a given spacing from each other.

Figures 5, 6:
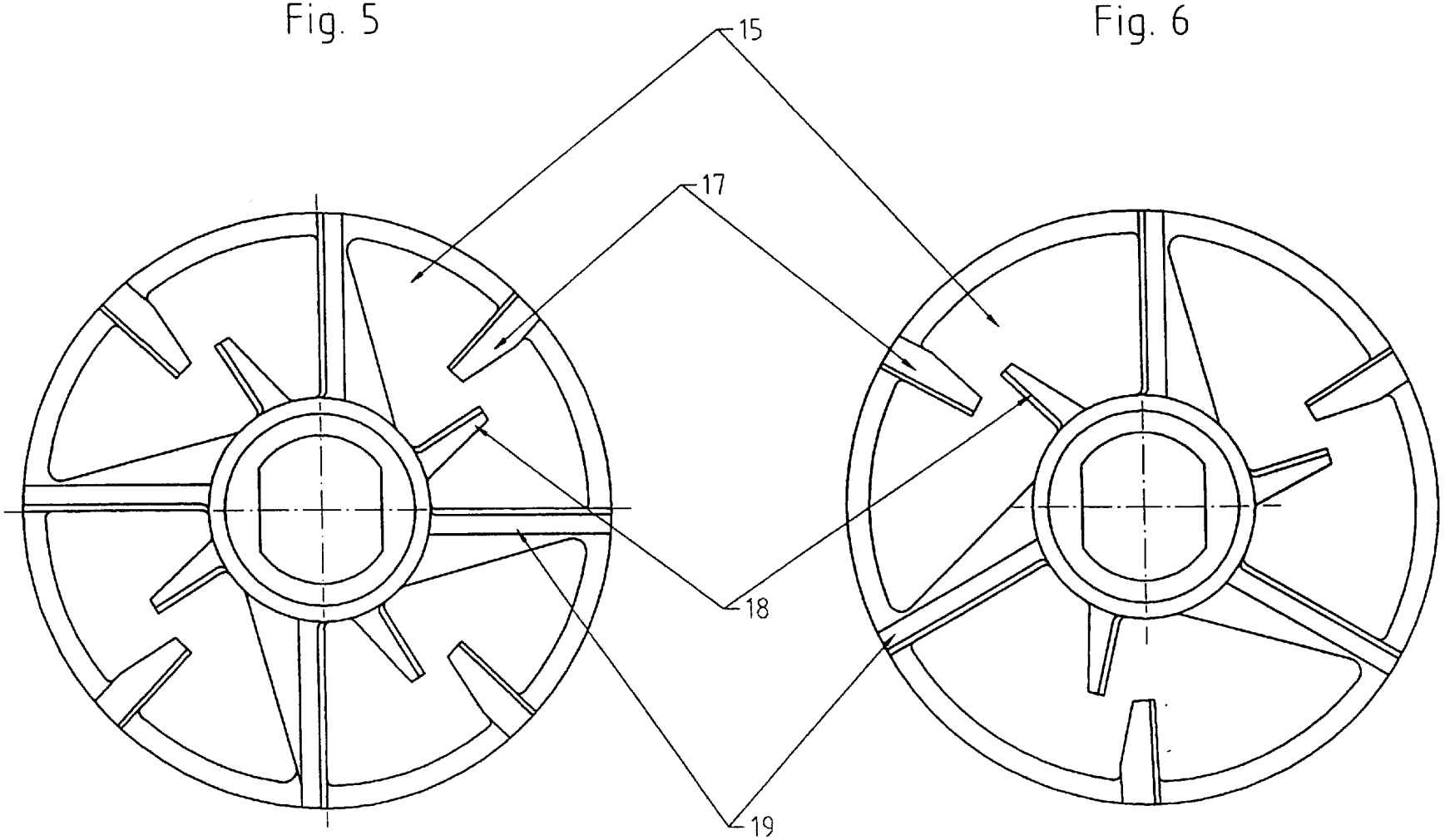
FIG. 5 depicts a knife provided with standing, hanging and uninterrupted blades.
FIG. 6 depicts another embodiment of a knife in accordance with the invention.

The front and rear surfaces 9, 10 of the perforated discs are planar surfaces disposed in parallel to each other, the front surface 9 facing the material to be chopped (not shown) and constituting a sliding surface for a rotating knife. The rear surface 10 is the output surface of the disc 1. As may be seen from FIG. 1, the disc 1 is provided with perforations 4 disposed parallel to the axis of the center bore 3. The blades of the knives 15 shown in FIGS. 5 and 6 form zonal knife spacing systems, sometimes referred herein as cutting zone 16, which lead to chopped material particles of uniform size.

Figure 1:
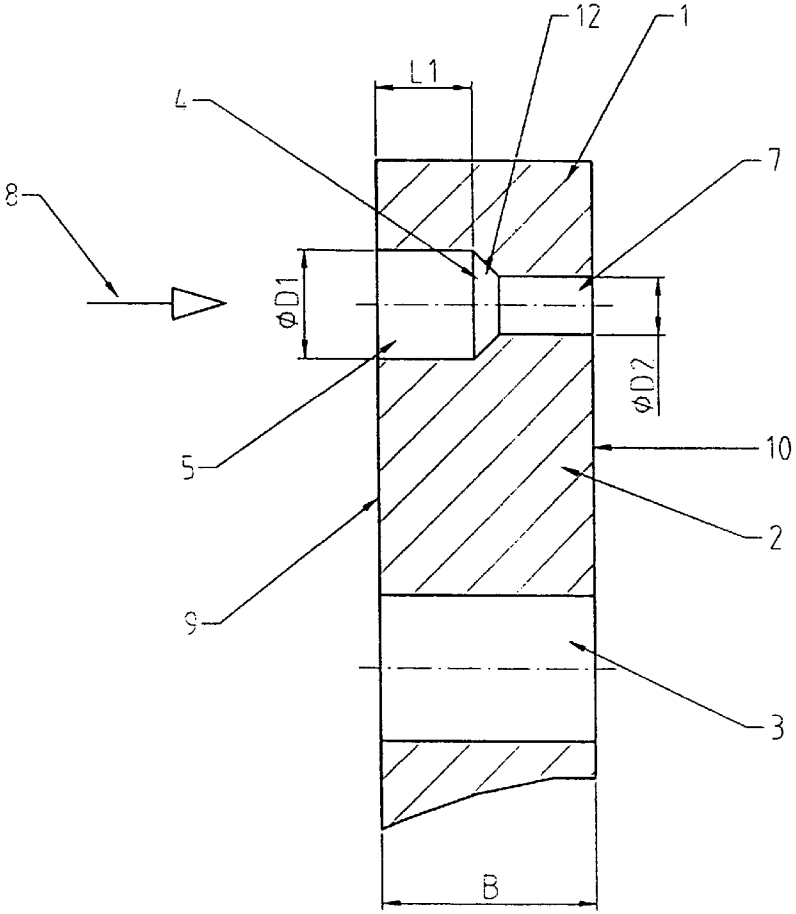
FIG. 1 depicts a perforation of stepped configuration.

As may also be seen in FIG. 1, the perforations 4 are of stepped configuration forming intake ends or sections 5 and output ends or sections 7 of different diameters, with a tapered shoulder or stricture being formed intermediate the intake and output ends to provide for a change in the flow of raw material. As shown in FIG. 1, the diameter $D_1$ of the intake end 5 is larger that the diameter $D_2$ of the output end 7. The tapered shoulder constitutes a massaging zone 12 where the material is kneaded, rolled or otherwise physically rearranged. A dwell zone L1 for temporarily retaining particles of chopped material is disposed ahead of the massaging zone 12. The size of the particles is determined by the cutting zones 16 (see FIG. 7).

Figure 2:
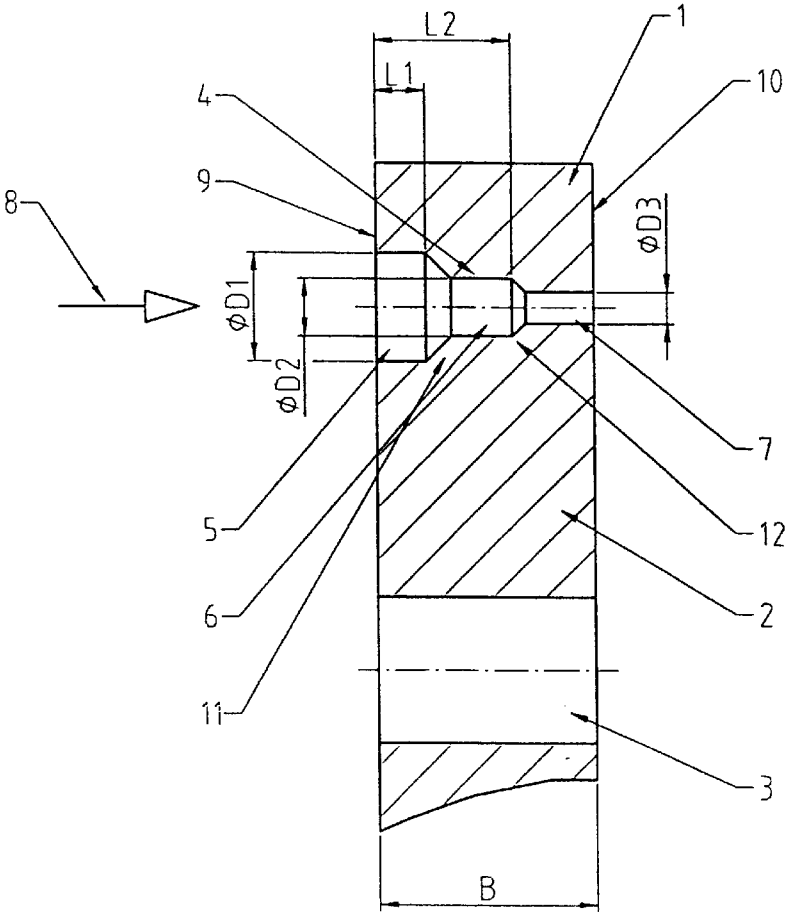
FIG. 2 depicts a perforation having a plurality of reducing steps.

The functional relationship between the input end 5 of the perforations 4 and the output end 7 and knife arm system or cutting zone 16 is determined by the geometric dimensions of the perforations 4. As shown in FIG. 2, the perforations 4 are segregated into an intake section 5, an intermediate section 6 and an output section 7. The longitudinal extent of the dwell zones 21 and of the massage zones 12 is a function of the diameters of those sections.

Thus, the length of the dwell zone L1 of the perforated disc 1 shown in FIG. 1 is thrice or four times the diameter of the input section 5 and the overall width of the perforated disc 1 is determined by the ratio of 5 to 6 times $$\frac{D_1 + D_2 + D_3}{2},$$

wherein $D_3$=the diameter of the output section 7;

$D_2$=the diameter of the intermediate section 6;

$D_1$=the diameter of the intake section 5.

The perforation 4 of the perforated disc 1 schematically shown in FIG. 2 has multiple steps. The disc 4 may be called a "massaging disc" because of its plurality of transitional sections. The perforations 4 of this embodiment are divided into an intake section 5, an intermediate section 6, and an output section 7. In this embodiment the dwell zone 11 is located in the longitudinal extent of the intermediate section 7 and may be derived from the ratio of 1 to 2 times the diameter $D_2$ of the intermediate section 6.

The direct relationship between the diameters of the intake sections 5 and the output section 7 is in the range of from about 0.5 to about 0.95, whereas the lengths of the dwell zones, relative to the same diameters of the intake and output sections, are about once or twice or, depending upon the extent of the desired mixing and massaging of the raw material, thrice to four times the diameter of the intake or output sections 5, 7.

Figure 4:
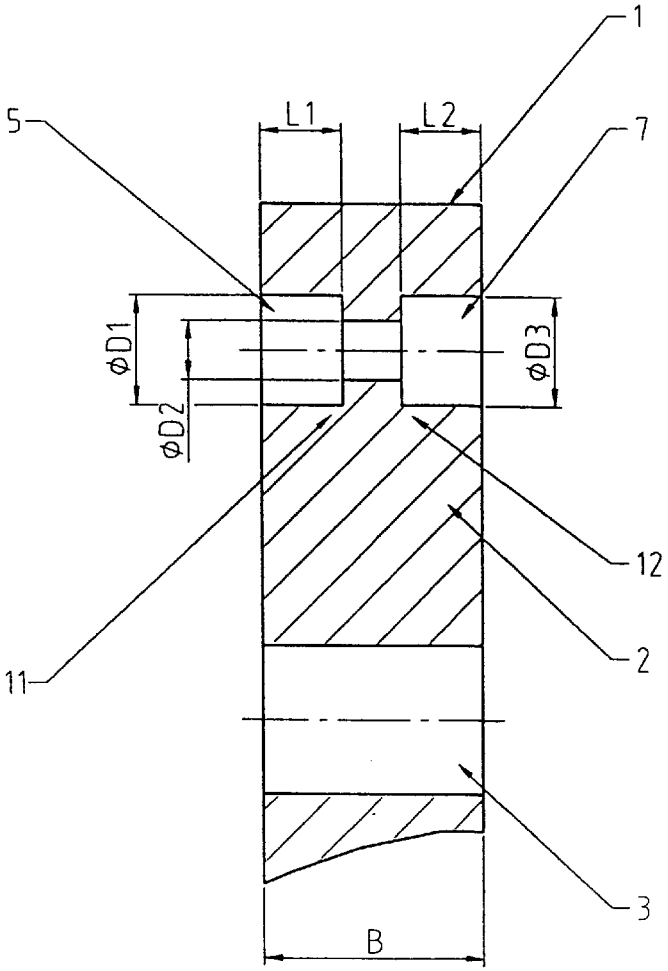
FIG. 4 depicts a perforation having an intermediate section of reduced width.
Figure 3:
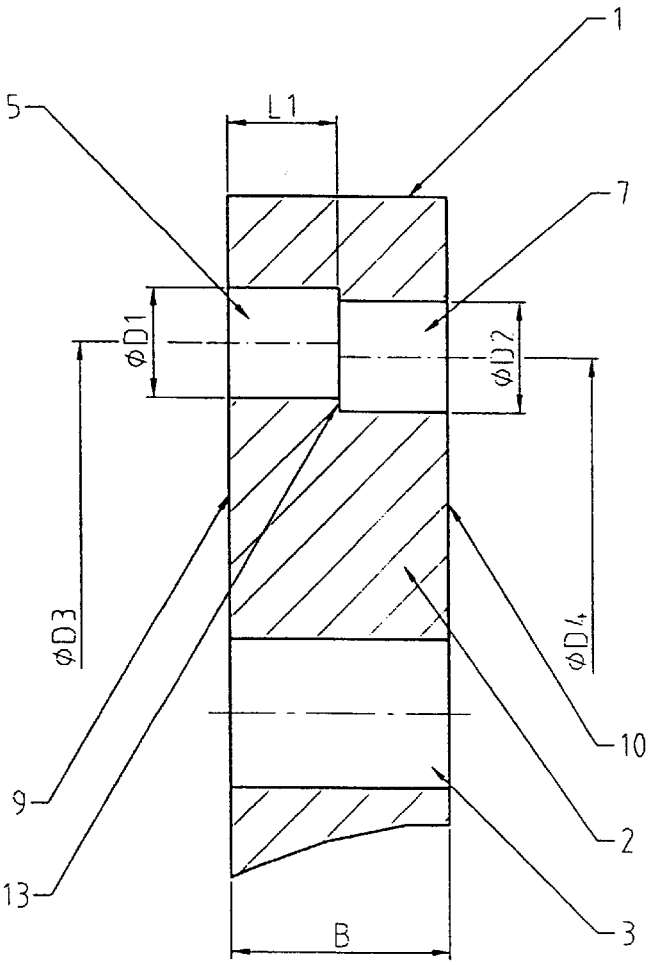
FIG. 3 depicts a perforation having axially offset end sections.

Further embodiments of perforated discs are shown in FIGS. 3 and 4. As shown in FIG. 3 the intake section 5 is radially offset from the output section 7, with a shoulder 13 being formed between the two sections to provide a dwell zone 11 and a massage zone 12. The diameters of the intake and output sections 5, 7 are identical.

The embodiment of FIG. 3 lends itself to efficient manufacturing techniques by axially offset bore being sunk into the front and rear surfaces 9 and 10 of the disc 4.

In accordance with FIG. 4 the diameters of intake section 5 and output section 7 are identical. A stricture is formed by a bore 14 of reduced diameter extending between the intake and output sections. A dwell zone is created at the transition between the intake and output sections.

Advantageously, perforated discs 1 in accordance with the invention will be arranged in pairs. That is to say, one or more perforated discs 1 are arranged in succession on the axial stud of a feed auger. In this manner, the dwell times of the raw material to be chopped may be altered. An arrangement including a plurality of perforated discs 1 is particularly useful where dwell and massage times are to be adjusted in relation to the raw material to be chopped.

Advantageously, the perforated discs 1 in accordance with the invention are heat-treated such that their front and rear surfaces are of different hardness. Preferably, the front surfaces 9 engaged by rotating knives will be harder than the rear surfaces.

A particular advantage derived from perforated discs made in accordance with the teachings of the instant invention is that the structure of the transitions in the stepped perforations 4, i.e., the intake section 5, the intermediate section 6 (if provided) and the output section 7, leads to the provision of congesting, massaging and friction systems which subject the material pressed through the perforations, such as meat, to kneading, rolling and friction to improve its cohesion and, thus, its water absorbency. This, in turn, results in a higher quality of the end product.

Whereas the structure and configuration of the perforations 4 in the discs 1 substantially improve mixing and cohesion of the material being processed, the knives 15 cooperating with the discs serve to chop the material penetrated into the perforations into particles of uniform size. To this end, the knives are structured as hanging blades 17, standing blades 18 or uninterrupted blades 19. As herein defined, a hanging blade 17 is mounted on a peripheral ring and extends centripetally toward the hub of the knife. A standing blade 18 will be understood to be a blade extending from the hub of a knife toward the peripheral ring. Uninterrupted blades 19 are those extending from the hub to the ring.

Uniformity of the particles size is accomplished by the knives being structured in the manner described above and shown in FIGS. 5 and 6, with their blades 17, 18, and 19 being disposed at a predetermined distance from each other.

Figure 7:
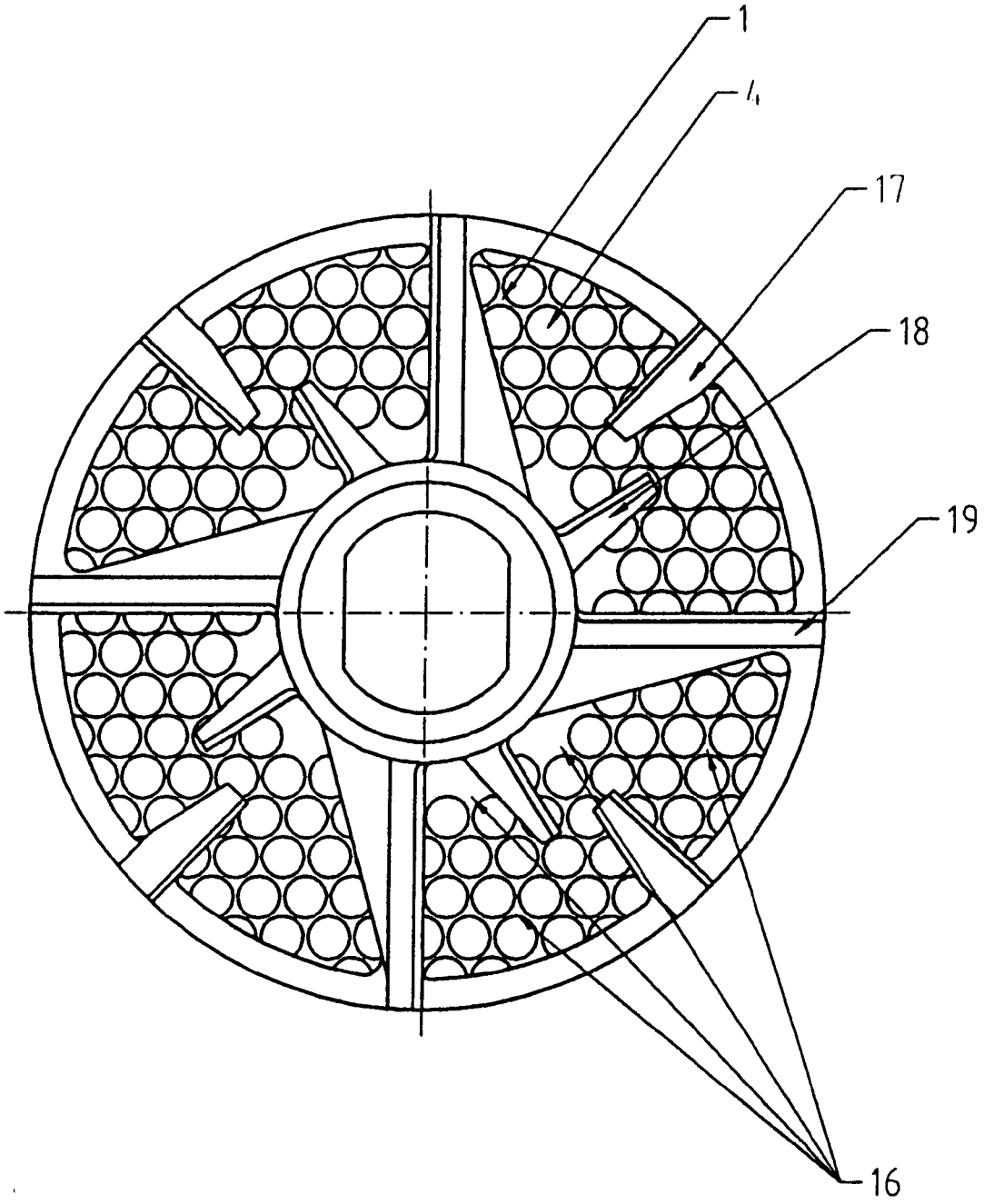
FIG. 7 the knife of FIG. 5 in front of a schematically shown perforated disc, seen in the direction of material feeding.

FIG. 7 depicts the arrangement of a perforated disc 1 with an associated knife 15. Matching the disc 1 with the knife 15 will be seen to result in cutting zones 16. Also, the knives blades 17, 18, 19 will be seen to be uniformly spaced from each other.

The arrangement of the blades 17, 18 and 19 of a knife 15 provides sufficient time to the material to penetrate into the perforations 4 of the disc 1 and to be chopped into particles of uniform size. It also ensures a uniform cutting action and, hence, uniform particle size, over the entire surface 9 of the disc 1, by simultaneous cutting at the outer and inner sections of the disc 1.

What is claimed is:

1. A cutter assembly for use in meat grinding apparatus of the kind provided with a feed auger adapted to be rotated about a predetermined axis, comprising:

a disc adapted to be coaxially mounted with the feed auger and having a first surface facing the auger and a second surface disposed substantially parallel to the first surface and provided with a plurality of perforations distributed over and extending between the first and second surfaces in a direction substantially normal to the first and second surfaces, the perforations having a first section extending from the first surface and at least a second section separated from the first section by a constriction; and a knife adapted to be rotatably driven about the axis in sliding engagement with the first surface and comprising a plurality of blades disposed radially with respect to the axis and spaced uniformly relative to each other.

2. The assembly of claim 1, wherein the first and second sections are axially aligned and wherein the diameter of the first section is larger than the diameter of the second section.

3. The assembly of claim 2, wherein the constriction comprises an annular tapered shoulder connecting the first and second sections.

4. The assembly of claim 1, wherein the first and second sections are radially offset and of uniform diameter.

5. The assembly of claim 1, further comprising a third section extending between the second section and the second surface.

6. The assembly of claim 5, wherein the third section has a diameter smaller than the diameter of the second section and wherein an annular tapered shoulder connects the second and third sections.

7. The assembly of claim 5, wherein the diameter of the first and third sections is larger than the diameter of the second section and wherein the second section is disposed intermediate the first and third sections.

8. The assembly of claim 7, wherein the diameter of the first and third sections are identical.

9. The assembly of claim 8, wherein the first, second and third sections are axially aligned and wherein annular shoulders are formed between the first and second and second and third sections.

10. The assembly of claim 5, wherein the ratio of the diameter between the first and second and between the second and third sections is between 1:0.5 and 1:0.95.

11. The assembly of claim 5, wherein the width of the disc is substantially five to six times half the sum of the diameters of the first, second and third sections.

12. The assembly of claim 1, wherein the first section constitutes a dwell zone and the second section constitutes a massage zone and wherein the length of the dwell zone is substantially thrice to four times the diameter of the first section and the length of the massage zone is substantially once to thrice the diameter of the second section.

13. The assembly of claim 1, wherein the hardness of one of the surfaces is greater than the hardness of the other surface.

14. The apparatus of claim 13, wherein the knife is disposed in engagement with the harder surface.

15. The apparatus of claim 14, wherein the knife comprises a peripheral ring and a hub disposed axially thereto and wherein a plurality of uniformly spaced first knife blades extends centripetally from the ring toward the hub, a plurality of uniformly spaced second knife blades extends radially from the hub toward the ring, and a plurality of uniformly spaced third knife blades extends from the hub to the ring.

16. The assembly of claim 15, wherein the first and third knife blades are spaced evenly relative to each other and the second knife blades are disposed between the first and third knife blades.

17. The assembly of claim 15, wherein the number of each of the first, second and third knife blades is four.

18. The assembly of claim 15, wherein the number of each of the first, second and third knife blades is three.

* * * * *